United States Patent [19]

Bauman et al.

[11] 3,996,684

[45] Dec. 14, 1976

[54] BOLT LATCH

[75] Inventors: Thomas G. Bauman; Robert J. Balaska, both of Ilion, N.Y.

[73] Assignee: Remington Arms Company, Inc., Bridgeport, Conn.

[22] Filed: Dec. 18, 1975

[21] Appl. No.: 641,962

[52] U.S. Cl. ..... 42/16; 89/185

[51] Int. Cl.[2] ..... F41C 11/06

[58] Field of Search ..... 42/16, 20, 17, 21, 2, 42/8, 12, 40, 75 D; 89/172, 185

[56] References Cited

UNITED STATES PATENTS

| | | | |
|---|---|---|---|
| 874,856 | 12/1907 | Mason | 42/16 |
| 1,228,827 | 6/1917 | Saalfield | 42/16 |
| 1,802,198 | 4/1931 | Cosmi | 42/21 |
| 2,941,449 | 6/1960 | Reed | 42/16 |
| 2,960,917 | 11/1960 | Lizza | 42/16 |
| 3,318,192 | 5/1967 | Miller et al. | 42/16 |
| 3,653,140 | 4/1972 | Alday | 42/16 |

*Primary Examiner*—Charles T. Jordan
*Attorney, Agent, or Firm*—John H. Lewis, Jr.; Nicholas Skovran; William L. Ericson

[57] ABSTRACT

A bolt latch for use in a firearm having a rotary locking system in which the latch locks the rotational movement of the bolt at all times during the cycle of operations of the gun except during locking and unlocking of the bolt head with the barrel extension.

The bolt latch is pivotally mounted to the bolt carrier for movement perpendicular to the axial movement of the bolt and is spring biased outwardly into bolt blocking position wherein the bolt cannot move relative to the bolt carrier and thus rotation of the bolt is prevented. The bolt latch is actuated into non-blocking position (i.e. rotation of the bolt is permitted) as the bolt approaches the breech-closed position by a cam means on the firearm.

10 Claims, 8 Drawing Figures

BOLT LATCH

The present invention relates to an autoloading firearm, preferably a break-open type, having a rotary bolt locking system. More particularly, the invention relates to a bolt latch which selectively prevents rotary movement of the bolt so as to orient the bolt head to move in a selected straight linear path during bolt travel to and from the closed breech position.

Still more specifically, the invention relates to a cross bolt latch arrangement which is pivotally mounted on the bolt carrier and spring biased outwardly into bolt blocking position to prevent linear movement of the bolt relative to the bolt carrier, thus preventing rotary movement of the bolt head until the locking lugs on the bolt head are ready to be rotatably locked into or out of engagement with corresponding portions of the barrel assembly.

The idea of orienting the bolt in a rotary bolt locking system so as to prevent binding of the bolt head locking lugs with receiver locking abutments caused by misalignment of the bolt with the receiver is not new. Two patents showing this idea are U.S. Pat. No. 2,960,917 issued to Albert J. Lizza on Nov. 22, 1960 and U.S. Pat. No. 3,653,140 issued to James M. Alday on Apr. 4, 1972. However, it is believed that the present bolt latch concept, which can be used with break-open type firearms, is novel.

A number of advantages can be attributed to the present invention. The present bolt latch system remains latched, even when the firearm is disassembled for cleaning or general breakdown into the firearm's component parts. The bolt latch systems of the prior art patents cited above would not stay latched since the latch means of each system would fall out of the firearm upon disassembly of the bolt carrier with the receiver.

The present latch means is more positive in that the bolt latch is constantly spring biased outwardly into bolt blocking position (or rotary locking position) except for the brief period when the locking lugs on the bolt head are committed to move into and out of the recesses defined by the locking abutments on the barrel extension, i.e. just prior to lockup and just after lockup of the bolt head into the barrel assembly, as the bolt head is rotated into locking or unlocking position. This results in keeping the bolt head oriented in a straight linear path during the rearward travel of the bolt assembly, locked open position and forward travel of the bolt assembly during feeding, prior to locking.

While the patents cited above have somewhat similar objectives, the present invention is an improvement in several other respects in addition to those mentioned above. The present invention includes a secured latch pin which is essentially free of bolt load. The bolt latch itself pivots on the latch pin and is spring biased into bolt-blocking position rather than being cammed into bolt blocking position. The bolt latch is a cross-bolt arrangement wherein the latch acts perpendicular to the axial direction of the bolt movement so that there is substantial bearing surface on the latch upon which the bolt force is exerted. Furthermore, the latch is located in a slot cut into the bolt carrier so that the major portion of the bolt latch is supported by the bolt carrier. Because of this construction, the load caused by the explosive gases acting on the bolt are ultimately supported by the bolt carrier rather than the bolt latch alone, and it would take a substantial shearing force to move the bolt relative to the carrier when the bolt latch is in the bolt blocking position. Bolt references mentioned above require a cam roller to be positioned between so as to engage the side wall of the firearm frame and the outside diameter of the bolt. Obviously, the cumulative effect of tolerances in the inside side wall of the firearm frame, the outer diameter of the bolt, and the outside diameter of the roller pin or detent become important considerations in proper operation of the bolt latch and thus machining tolerances are much more critical for proper operation of the systems.

The present invention is more flexible in the event that something gets out of phase or if the parts are not lined up correctly. Since the bolt latch is spring biased into bolt-blocking position-and not cammed, if there is an out-of-phase relationship, the result will be that the spring will not act and nothing happens to the firearm. If there is an out-of-phase situation when the roller pin or detent is mechanically cammed into bolt-blocking relationship, it could result in binding of the parts and possibly bending of the firearm frame.

It is an object of the present invention to provide an improved bolt latching system for a firearm having a rotary bolt locking system.

It is another object of this invention to provide a pivoted, cross-bolt latching arrangement which is spring biased outwardly into bolt-blocking or rotary locking position.

It is still another object of this invention to provide a bolt latching system which remains latched when the firearm is disassembled so that the action bar assembly, bolt carrier, bolt means and bolt latch can be removed as a unit.

These and other objects of the invention will become apparent when considered with the drawings in which.

Generally, the present invention is for a bolt latch for a firearm having a rotary bolt locking system. A bolt carrier is rigidly mounted on an action bar assembly that is reciprocal from a forward breech closed position to a rear breech open position. Cam means interengage between the bolt carrier and the bolt. Reciprocation of the bolt carrier produces reciprocation of the breech bolt when the bolt and bolt carrier are locked together and causes rotation when the carrier and bolt are not locked together by virtue of the bolt latch. The bolt has at least one locking lug on its bolt head, which in its breech closed position, is located forwardly of a corresponding locking abutment on the barrel assembly. The bolt latch extends perpendicular to the axial movement of the bolt and is pivotally mounted on one side of the carrier. It is normally spring biased outwardly to block the linear path of the bolt stem in the bolt carrier. This in turn prevents rotation to take place because linear travel of the cam pin in the bolt stem or shank is trying to work through a helix, or cam path, but is not allowed to do so while the bolt latch is obstructing its path. Thus, the bolt stays in its initial position or "locked".

A cam means mounted on the barrel extension, but which could be mounted on the frame, actuates the bolt latch to move it out of bolt blocking position when the bolt head approaches the breech closing position and the bolt locking lug is located forwardly of the locking abutment of the barrel assembly thus causing the bolt head and associated locking lug to move into or out of locking position depending on whether the carrier is moving forwardly toward the breech closed position or rearwardly toward the breech open position.

Figure 1:
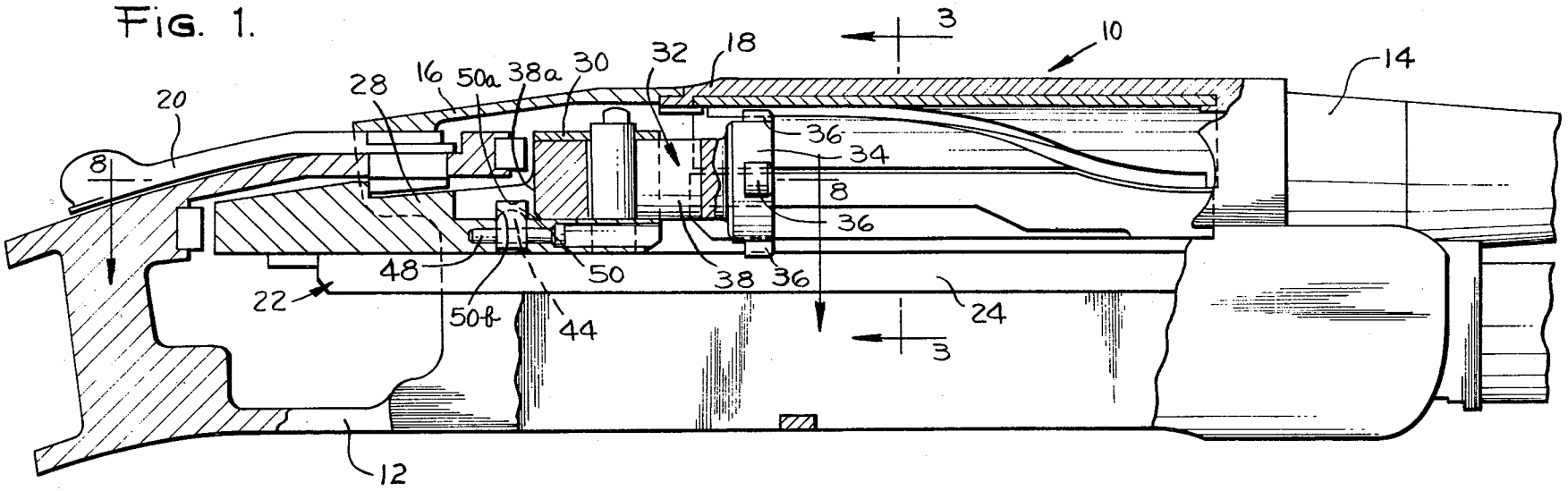
FIG. 1 is a side view (with portions shown in cross section) of a break-open shotgun in breech open position with the bolt means fully extended relative to the bolt carrier and positioned in its rearmost position.
Figure 8:
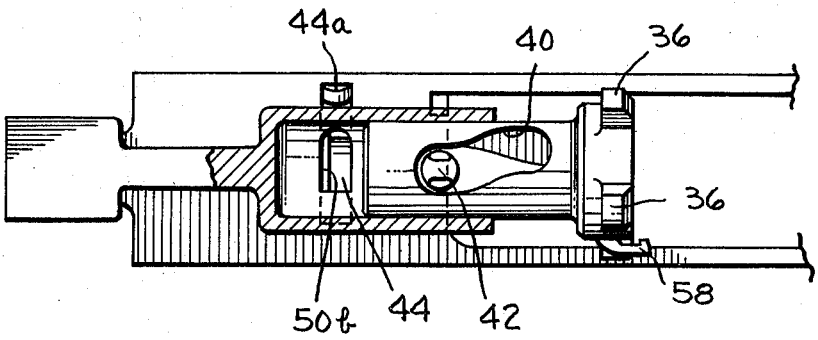
FIG. 8 is a plan view taken in line 8—8 in FIG. 1 showing a portion of the action bar assembly with the bolt in the fully extended position relative to the bolt carrier and locked in place by the bolt latch.

Referring to FIG. 1, the side view shows a break-open firearm 10 in closed position. The frame 12 and the barrel assembly 14 are hinged in any conventional manner not shown and not pertinent to the present invention. A top lock 16 is shown engaging the rear end of barrel extension 18 and is actuated in any well known manner by top lock lever 20. One method of actuating the top lock 16 is shown in application Ser. No. 490,514 filed by James C. Hutton et al. on July 22, 1974, now Pat. No. 3,949,507. Reciprocally mounted in the frame 12 is an action bar assembly 22 comprising two spaced-apart, forwardly-extending action bars 24 which are joined at their rear end portions by a connecting portion 26. A bolt carrier 28 is rigidly mounted on said connecting portion 26 so as to move therewith. Carrier 28 has a tubular portion 30 in which a bolt assembly 32 reciprocally and rotationally moves. Bolt assembly 32 includes a large diameter bolt head 34 having a plurality of spaced locking lugs 36 thereon and a smaller diameter, cylindrical slot stem or shank 38 extending rearwardly from the bolt head. A helical cam slot 40 is cut in said bolt stem and a cam pin 42 (see FIG. 8) is inserted through an opening (not shown) in the bolt carrier and through said helical cam slot so as to comprise a cam means for rotating the bolt assembly when the bolt assembly is moved in a linear direction relative to the bolt carrier (within the limits of the helical cam slot). This system of rotating a bolt assembly is not new.

FIG. 1 shows the bolt assembly 32 in the fully extended position, i.e. the bolt assembly is moved forward as far as it can relative to the bolt carrier 28. This position is reached, of course, when the cam pin 42 engages the rear end of cam slot 40. (See also FIG. 8)

Figure 3:
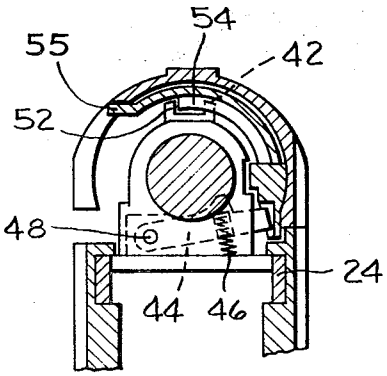
FIG. 3 is a cross sectional end view taken along line 3—3 in FIG. 1 showing the bolt latch in the bolt blocking or rotary locking position.
Figure 4:
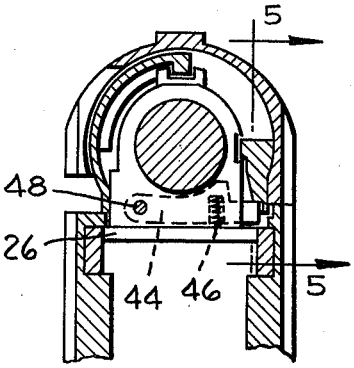
FIG. 4 is a cross sectional end view taken along line 4—4 in FIG. 2 showing the bolt latch in the depressed or inoperative position.

It is while the bolt assembly is in this fully extended position that the bolt latch 44 is spring biased upwardly by coil spring 46 (see FIG. 3) to project behind the rear end surface 38*a* (see FIG. 1) of the bolt stem 38 and except for a small amount of play, preventing linear as well as rotational movement of the bolt assembly relative to the bolt carrier. Referring again to FIG. 1, it can be seen that the bolt latch is pivoted on a pivot pin 48, which is positioned at one side of the bolt carrier. The latch is located in a slot 50 cut transversely in said bolt carrier. The top surface 50*a* of the bolt latch slot 50 limits the upward movement of the free end of the bolt latch. Also, from FIG. 1, it is seen that the rear surface 50*b* of slot 50 provides a positive and direct support for the bolt latch. From FIG. 8, it is seen that except for a small end portion 44*a* of bolt latch 44 which extends outwardly past the bolt carrier, the major portion of the bolt latch is supported by surface 50*b*. FIGS. 3 and 4 show that cam pin 42 has a cam groove 52 in which is positioned a downwardly projecting, helical cam rail 54 located on the underside of a rotatable port cover 55. The ends of the port cover 55 are supported by appropriate means on said barrel assembly so that when the bolt assembly moves forwardly from the position shown in FIG. 1, the cam groove 52 and helical cam rail 54 interact to rotate the port cover and close the port opening. FIG. 3 shows the bolt latch 44 spring biased into bolt blocking position and the port cover in the retracted position. The rotatable port cover will be the subject of a subsequent application, and details are not provided here since they are not pertinent to the invention as claimed.

Figure 2:
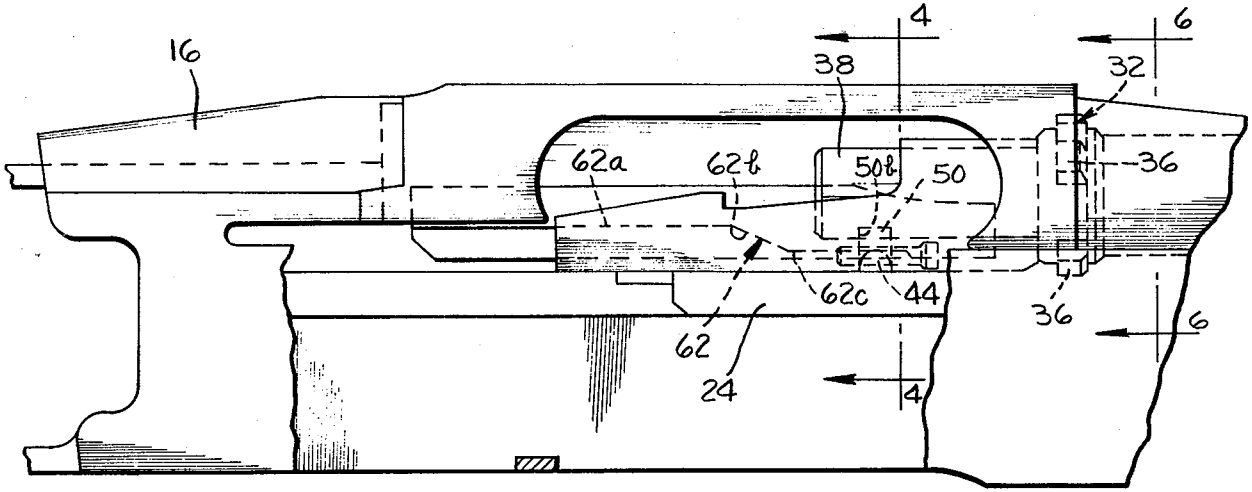
FIG. 2 is a side view of a break-open firearm similar to FIG. 1 with the bolt means in the breech closed position and rotated into locking engagement with the barrel extension.
Figure 5:
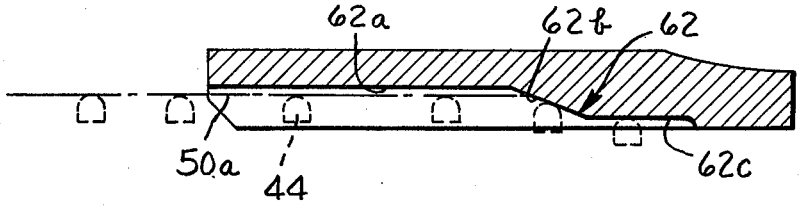
FIG. 5 is a cross sectional end view taken along line 5—5 in FIG. 4 and shows the cam means for moving the bolt latch out of bolt-blocking position.

FIG. 2 shows the bolt assembly 32 in the forward breech closed and locked position. From FIGS. 3 and 6, it will be seen that before the bolt assembly can reach the breech closed position shown in FIG. 1, it is necessary for bolt head locking lugs 36 to be properly oriented so as to pass through the recesses formed by the locking abutments 56 of the barrel extension 18 as well as pass by the ejector rail 60 (see FIG. 7). Ejector rail 60, which is attached to the side of the barrel assembly, has its lower edge cut to form a cam surface 62 comprising three distinct portions (see FIG. 5). Portion 62*a* is the initial long horizontal portion and is positioned slightly above the top surface 50*a* of bolt latch slot 50. Actually, surface 62*a* is not a cam surface since the top of the bolt latch 44 engages the top surface 50*a* and not surface 62*a*, thus preventing wear and binding of the bolt latch during this portion of travel. Portion 62*b* is an inclined cam portion where the end portion 44*a* of the bolt latch is being cammed so as to be depressed downwardly against the coil spring. Portion 62*c* is the final cam surface wherein the bolt latch is depressed out of bolt blocking position. When the bolt latch is depressed by cam surface 62*c*, further forward movement of the bolt carrier coupled with the force exerted against the bolt head when it is in breech closed position results in relative linear movement between the bolt and the carrier thus causing bolt rotation and the locking of the bolt locking lugs in front of the barrel locking abutments.

Figure 6:
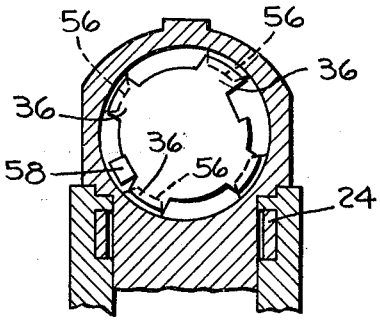
FIG. 6 is a cross sectional end view taken along line 6—6 in FIG. 2 showing the bolt head locking lugs rotated into locked position in front of the barrel extension locking abutments.

The operation of the bolt latching system can now be summarized. Beginning with the firearm as shown in FIGS. 2 and 6, the bolt head locking lugs 36 are locked solidly in front of opposing lugs 56 in the barrel extension 18 to support firing loads. At this time, the bolt latch 44 is being depressed by cam surface 62*c* provided on ejector rail 60 and is essentially inoperative at this time. The action bar assembly 22 is being pushed and biased forwardly by an action spring (not shown) through action spring links. The use of an action spring and corresponding links are not new and can be seen for example by elements 18 and 17 in U.S. Pat. No. 3,200,710, issued to R. P. Kelly et al. on Aug. 17, 1965.

The force of the action spring is also what keeps the bolt head locked in the barrel extension as the cam pin 42 is pushed to its extreme forward position in the helix 40 or cam path of the bolt shank 38. This gives maximum rotation of the bolt head into the locked position.

After firing takes place, a portion of the expanding gases is metered through conventional orifice holes in the firearm barrel to push an inertia sleeve (not shown) and ultimately the action bar assembly rearwardly in any well known manner. The action bars 24 move a short distance (dwell) without cam pin 42 working in helix slot 40 in bolt shank 38. Then the cam pin works on the bolt shank helix for a predetermined (by the cam portion of the slot) linear action bar travel and the bolt is rotated. At this point, the cam surface 62*c*, on the bottom of the ejector rail, changes to upwardly inclined cam surface 62*b* whereupon upward movement of the spring biased bolt latch 44 is limited by the inclined cam surface 62*b*.

Continued rearward movement of the action bars again works in the helical slot 40 for a short dwell distance before the bolt head 34 is picked up by the bolt carrier 28 when the cam pin 42 reaches its rearwardmost position in the helix slot and the bolt and the carrier then move as one unit. By this time, the bolt latch 44 is well up behind the bolt shank 38 preventing its movement, linear or rotational.

Now that the bolt is fully unlocked from the locking abutments in the barrel extension and is moving rearward, the bolt latch has reached its maximum upward position, as determined by the upper surface 50*a* of transverse slot 50 in the bolt carrier. The cam surface 62*a* on the ejector rail continues on past the maximum movement of the bolt latch in the "up" direction to allow clearance, preventing binding of the parts during the rest of the cycle of operation of the firearm (see FIG. 5).

Figure 7:
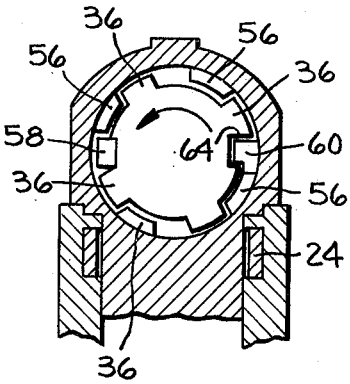
FIG. 7 is a cross sectional end view similar to FIG. 6 except that the bolt head locking lugs have not been rotated into locking position as yet.

The bolt latch stays up behind the bolt shank during the cycles of operation of extraction, cocking, ejection, locking open, feeding, and loading. The bolt head must stay locked into position and be oriented in relation to the locking lugs during these cycles of operation so that:

(a) the extractor 58 maintains its correct position for extraction of the cartridge shell (see FIG. 7); (b) the ejector 60 must line up with a slot 64 in the bolt head to provide a surface for ejection (see FIG. 7); (c) clearance must be maintained between the port cover cam rail 54 and locking lugs 36 on the bolt head; (d) correct alignment must be maintained for the bolt head to reenter appropriate clearance cuts in the barrel extension on forward movement of the action bar assembly prior to locking up (see FIG. 7); and (e) the bolt head can maintain a surface for feeding the shell into the firearm chamber.

The action bar-bolt carrier assembly, upon returning forwardly and approaching the locking up phase, holds the bolt head in alignment with the locking lug recesses in the barrel extension. Once the locking lugs 36 on the bolt head are committed into the recess cuts in the barrel extension, the bolt latch begins to be cammed out of its holding or blocking position behind the bolt shank by the cam surface 62b on the ejector rail.

By the time the locking lugs 36 of the bolt head pass the locking abutments 56 of the barrel extension, the bolt latch is completely cammed out of engagement with the bolt shank (by means of cam surface 62*c*), thus allowing the bolt head to be rotated by the cam pin 42 and helical slot 40 in the bolt carrier 28 to a locked position.

What is claimed is:

1. In a break-open firearm having a barrel assembly hinged to a frame to permit pivotal movement of the barrel assembly and frame from a closed position to a break-open position, an action bar assembly reciprocally mounted in said frame to move from a rear, breech-open position to a forward, breech-closed position, bolt carrier means rigidly mounted on said action bar assembly, bolt means slidably and rotatably mounted in said bolt carrier means, cam means responsive to relative linear movement of said bolt means and said bolt carrier means for rotating said bolt means into locking and unlocking engagement with said barrel assembly, a bolt latch for selectively preventing linear movement of said bolt means relative to said bolt carrier means, means pivotally mounting said bolt latch for movement to bolt-blocking position transversely to the linear direction of movement of said action bar assembly, means for disengaging said bolt latch to permit such relative linear movement of the bolt means and the bolt carrier means when the action bar assembly is in the forward, breech-closed position, said action bar assembly, bolt carrier, bolt means, and bolt latch being self-contained so as to be removable as a unit from said frame when disassembled.

2. In a break-open firearm as recited in claim 1 wherein said means mounting said bolt latch on said bolt carrier comprises a transverse slot having at least an upper stop surface and a rear support surface in said bolt carrier in which the bolt latch is positioned, a longitudinally extending pivot pin mounted at one side of said bolt carrier on which said bolt latch is pivotally mounted, and spring means for biasing said bolt latch outwardly into blocking position, the outward movement of the bolt latch being limited by said upper surface of said transverse slot, and said rear support surface providing support to the bolt latch when said latch is in bolt blocking position.

3. In a break-open firearm as recited in claim 2 wherein said bolt means comprises a forward bolt head and a cylindrical bolt stem extending rearwardly therefrom, said cam means comprising a helical cam slot in said bolt stem and a cam pin connected to said bolt carrier and extending through said cam slot, said bolt stem further comprising a rear end face which is normally blocked by the transversely positioned and outwardly biased bolt latch to prevent relative linear movement and thus rotation between the bolt means and the bolt carrier means.

4. In a break-open firearm as recited in claim 3 wherein said barrel assembly has at least one locking abutment and said bolt head has at least one locking lug which is radially offset from said locking abutment when the action bar assembly is in any position other than the closed breech position, said means for disengaging said bolt latch from said normally spring-biased bolt blocking position and causing rotation of said bolt head and its locking lug comprising a cam surface for depressing said bolt latch against the spring bias until the bolt stem can ride over the bolt latch and permit movement of the bolt means relative to the bolt carrier means thus effecting rotation of the bolt head into locking or unlocking position depending on the direction of movement of the action bar assembly, said cam surface engaging said bolt latch only during the locking and unlocking portion of the bolt travel cycle.

5. In a firearm having an action slide means mounted therein to reciprocate forwardly to breech-closed position and rearwardly to breech-open position, a bolt carrier rigidly mounted on said action slide means so as to move therewith, a breech bolt reciprocally and rotatably disposed within said bolt carrier, cam means interengaging between the bolt carrier and the breech bolt for producing a limited amount of reciprocation and rotation of the bolt when the bolt carrier is reciprocated within the frame, an elongated bolt latch, means pivotally mounting one end of said bolt latch to said bolt carrier so as to move in a plane transversely to the axial movement of the breech bolt, spring means biasing said bolt latch upwardly to block rearward movement of the breech bolt relative to the bolt carrier when the breech bolt is fully extended relative to the bolt carrier thus preventing actuation of the cam means and rotation of the bolt, and a second cam means on said firearm for engaging the free end of said bolt latch only when the bolt carrier and fully extended bolt are in breech closing position whereupon the bolt latch is forced downwardly against the spring bias out of bolt blocking position so that further movement of the bolt carrier will result in rotation of the bolt into locking or unlocking position, depending on whether the action slide means and bolt carrier are moving forwardly toward breech closing position or rearwardly toward breech-open position.

6. In a firearm as recited in claim 5 wherein said means pivotally mounting said bolt latch comprises an elongated pivot pin mounted on one side of said bolt carrier and extending parallel to the longitudinal axis of bolt travel, said bolt latch pivotally mounted on said pin to move perpendicular to the longitudinal axis of both travel into and out of bolt blocking position.

7. In a firearm as recited in claim 6 wherein said bolt latch is positioned in a slot located in said bolt carrier transversely to the longitudinal axis of bolt travel, said slot comprising a rear bearing surface which supports the major portion of the bolt latch when in bolt blocking position and an upper stop surface which limits the distance that the bolt latch can be biased upwardly into bolt blocking position.

8. In a gas operated, break-open firearm having a frame and a barrel assembly hinged thereto so as to permit pivotal movement of the barrel assembly from a closed position to a break-open position, a plurality of locking abutments on said barrel assembly, an action bar assembly reciprocal in said frame from a rear breech-open position to a forward breech-closed position, a bolt carrier rigidly positioned on said action bar assembly and a bolt means having locking lugs thereon, said bolt means being disposed within said bolt carrier, a helical cam slot in said bolt means and a cam pin attached to said bolt carrier and extending through the helical cam slot so that upon reciprocation of said bolt means relative to said bolt carrier, the bolt means is rotated, a bolt latch on said bolt carrier, means pivotally mounting said latch for movement transversely to the longitudinal axis of movement of said action bar assembly, spring means biasing said bolt latch upwardly to block movement of said bolt relative to said bolt carrier when the bolt means is fully extended relative to the bolt carrier thus preventing said cam pin from moving in said helical cam slot and rotating said bolt means, and cam means on said barrel assembly for depressing said bolt latch only when the fully-extended bolt means is in breech-closing position for unlatching the bolt and allowing relative movement of the bolt and the bolt carrier to cause rotation of the bolt and its locking lugs to lock with said locking abutments on said barrel assembly when the bolt carrier is moving forwardly to breech-closed position and unlock when the bolt carrier is moving rearwardly to breech-open position.

9. In a gas operated, break-open firearm as recited in claim 8 wherein said means pivotally mounting said bolt latch comprises a pivot pin on said bolt carrier extending in a longitudinal direction parallel to the axial direction of movement of said bolt means, said bolt latch pivotally mounted on said pivot pin for perpendicular movement thereto into bolt blocking position.

10. In a gas operated, break-open firearm as recited in claim 8 wherein said cam means for depressing said bolt latch comprises a cam surface positioned on the underside of an ejector plate which in turn is attached to the side of the barrel extension.

* * * * *

UNITED STATES PATENT AND TRADEMARK OFFICE

CERTIFICATE OF CORRECTION

PATENT NO. : 3,996,684

DATED : DECEMBER 14, 1976

INVENTOR(S) : THOMAS G. BAUMAN/ROBERT J. BALASKA

It is certified that error appears in the above-identified patent and that said Letters Patent are hereby corrected as shown below:

Col. 2, Line 60, "in Line 8-8" should read as "along Line 8-8". Col. 3, Line 48, "slot" should read as "bolt". Col. 6, Line 36, after into insert --bolt--. Col. 8, Line 25, after bolt insert --latch--.

Signed and Sealed this

Eighth Day of March 1977

[SEAL]

*Attest:*

RUTH C. MASON
*Attesting Officer*

C. MARSHALL DANN
*Commissioner of Patents and Trademarks*